United States Patent [19]

Pasche

[11] 4,015,610

[45] Apr. 5, 1977

[54] CIGARETTE FILTER TIP

[75] Inventor: René C. Pasche, Lausanne, Switzerland

[73] Assignee: Baumgartner Papiers S.A., Switzerland

[22] Filed: Feb. 6, 1976

[21] Appl. No.: 655,980

Related U.S. Application Data

[63] Continuation-in-part of Ser. No. 537,766, Dec. 31, 1974, abandoned.

[30] Foreign Application Priority Data

Feb. 4, 1974 Switzerland ..... 1472/74

[52] U.S. Cl. ..... 131/9; 131/261 R; 131/263

[51] Int. Cl.[2] ..... A24B 15/02

[58] Field of Search ..... 131/263, 8 A, 10.7, 131/10.9, 11, 264, 265, 266, 261 R, 262 R

[56] References Cited

UNITED STATES PATENTS 3,370,592 2/1968 Schultz et al. ..... 131/263 X

FOREIGN PATENTS OR APPLICATIONS 1,094,642 12/1967 United Kingdom ..... 131/263

OTHER PUBLICATIONS

*The Condensed Chemical Dictionary*, 5th edition, Reinhold. Pub. Co., N. Y., 1956, p. 677.

*Primary Examiner*—Robert W. Michell
*Assistant Examiner*—Vincent Millin
*Attorney, Agent, or Firm*—Robert E. Burns; Emmanuel J. Lobato; Bruce L. Adams

[57] ABSTRACT

A cigarette filter tip comprises three filter elements disposed end-to-end within a tubular outer coating of transparent sheet material. The two filter elements at the ends of the filter tip are of fibrous material while the central element is granular and comprises an iron sulfate which changes color upon reaction with hydrogensulfide in the cigarette smoke to form an iron sulfide. A paper band which units the tip with the cigarette extends only around one of the fibrous filter elements of the tip, thus leaving the granular filter element wholly visible.

4 Claims, 1 Drawing Figure

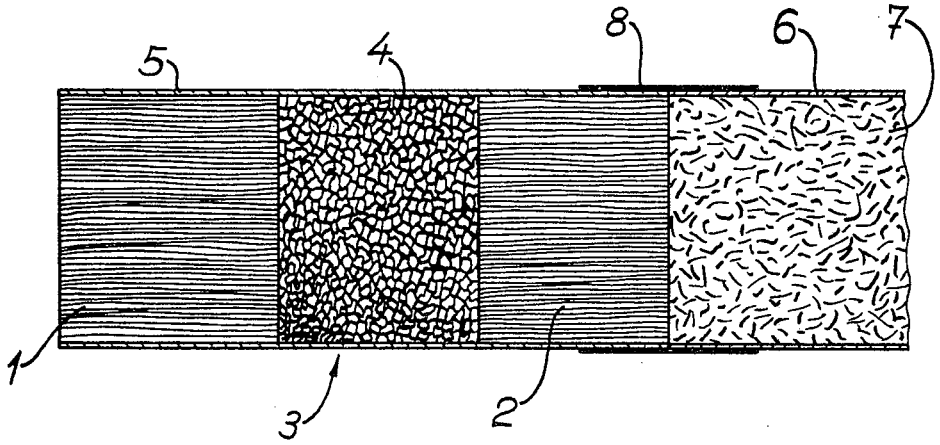
5
4
8
6
7
1
3
2

CIGARETTE FILTER TIP

REFERENCE TO PRIOR APPLICATION

This application is a continuation-in-part of my application, Ser. No. 537,766, filed Dec. 31, 1974 now abandoned.

FIELD OF INVENTION

The present invention relates to cigarette filter tips and particularly to multiple element tips which include means for dissipating and visually indicating noxious components in the cigarette smoke.

BACKGROUND OF INVENTION

Filter tips are becoming more widely used and more and more improved. Their efficiency has been increased and cigarette manufacturers place a great deal of emphasis on the efficiency of the filter tips on their cigarettes. However, users do not have the possibility of ascertaining the constitution of the filter tip without ripping and destroying it. Moreover, while filter tips are designed to remove certain noxious components in the smoke produced by combustion of the tobacco, there is no way of the user knowing whether in fact such components are being removed.

SUMMARY OF THE INVENTION

It is an object of the present invention to enable a user to ascertain the constitution of a cigarette filter tip without damaging it. To this end according to the invention, a cigarette filter tip comprises an outer coating which is transparent so as to permit visual inspection of the filter elements comprising the tip. Moreover, the filter tip includes a granular filter element which comprises material tha changes color by reaction of noxious components in the smoke produced by combustion of the cigarette tobacco. This filter element thus indicates that a noxious component is present in the smoke and that it is being removed or dissipated by the filter. The material which changes color comprises an inorganic iron sulfate which reacts with hydrogensulfide in the cigarette smoke to form iron sulfide. The change of color of the material thus indicates that hydrogensulfide is present in the smoke and that it is being removed by the filter through reaction with the iron sulfate.

BRIEF DESCRIPTION OF DRAWING

The nature, object and advantages of the invention will be more fully understood from the following description in conjunction with the accompanying drawing, the single figure of which is a longitudinal cross section of a filter tip in accordance with the invention fitted on the end of a cigarette.

DESCRIPTION OF PREFERRED EMBODIMENTS

The filter tip shown by way of example in the drawings comprises two fibrous filter elements 1 and 2 at opposite ends of the filter and a granular filter element 3 disposed between the fibrous filter elements. The elements 1, 2 and 3 of the filter tip are surrounded and held together by an outer coating or casing 5 of transparent sheet material for example, polypropylene, PVC or a film cellulose acetate. The filter tip is connected to a cigarette comprising cigarette paper 6 enclosing tobacco 7 by a jointing paper 8 which extends over only a small part of the casing 5 and of the cigarette paper 6.

The user is thus able to ascertain the nature of the filter at a glance.

The fibrous filter elements 1 and 2 are formed of porous and absorbent material for example crepe-like paper or other suitable cellulosic fibrous material. They serve the function not only of themselves filtering out undesirable products of combustion of the tobacco but also of retaining the granular material which comprises the central filter element 3.

The central filter element 3 comprises granules of a material which change color after a given retention of certain noxious components of the smoke. The granules may be composed of the color changing material or may be impregnated or coated with the color changing material. The color changing material may be combined with granules of activated carbon which serve as a filtering medium. Other filtering or neutralizing agents may be included in the filter element 3 as desired.

The material having the property of changing color upon reaction with a component of the smoke may comprise an inorganic iron sulfate, for example $Fe_2(SO_4)_3$ or $FeSO_4$ which react with hydrogensulfide in the smoke to form iron sulfide. The reaction may occur according to the following equations:

$$Fe_2(SO_4)_3 + 3_2S \rightarrow Fe_2S_3 + 3H_2SO_4 \quad (1)$$

$$FeSO_4 + H_2S \rightarrow FeS + H_2SO_4 \quad (2)$$

The chemical action that occurs has two beneficial results. In the first place by changing color the filtering material indicates the presence of hydrogensulfide in the tobacco smoke. In the second place the change of color indicates that the iron sulfate has reacted with the thereby removed the hydrogensulfide.

As described above the filter elements are enclosed in transparent material 5. The paper band 8 which units the filter with a cigarette obscures only a portion of one of the fibrous filter elements 2 leaving the granular filter element 4 wholly visible. Hence, a change of color of the central filter element can be readily observed by the smoker regardless of how the cigarette is turned.

The use of inorganic iron sulfates as the medium that changes color is advantageous by reason of their relatively low cost and their good chemical stability in the presence of high relative humidity such as that which prevails in cigarette factories. The material hence does not deteriorate during the manufacture and storage of the cigarette.

What I claim and desire to secure by Letters Patent is:

1. A filter tip cigarette comprising a cigarette section comprising tobacco wrapped in cigarette paper, a tip section comprising successively in a lengthwise direction a first fibrous filter element, a granular filter element and a second fibrous filter element and a transparent tubular casing holding said filter elements together in a unitary structure, said tip section being assembled in end-to-end relation with said cigarette section, and a band of joining paper wrapper around adjacent portions of said cigarette section and said tip section to join said cigarette section and tip section together, said joining paper extending only around a portion of one of said fibrous filter elements of said tip section, thus leaving said granular filter element wholly visible, said granular filter element comprising material which changes color by reaction of noxious components in smoke produced by combustion of said tobacco, said material which changes color comprising an inorganic iron sulfate which is transformed into an iron sulfide by reaction with hydrogensulfide in the cigarette smoke.

2. A filter tip cigarette according to claim 1, in which said inorganic iron sulfate is ferric sulfate ($Fe_2(SO_4)_3$).

3. A filter tip cigarette according to claim 1, in which said inorganic iron sulfate is ferrous sulfate ($FeSO_4$).

4. A filter tip cigarette according to claim 1, in which said granular filter element comprises granular activated carbon together with said material which changes color.

* * * * *